US006653911B2

(12) United States Patent
Estes et al.

(10) Patent No.: US 6,653,911 B2
(45) Date of Patent: Nov. 25, 2003

(54) BROAD BAND IMPEDANCE MATCHING DEVICE WITH REDUCED LINE WIDTH

(75) Inventors: John C. Estes, Tempe, AZ (US); Lei Zhao, Chandler, AZ (US); Anthony M. Pavio, Paradise Valley, AZ (US); William J. Thompson, Chandler, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/120,170

(22) Filed: Apr. 10, 2002

(65) Prior Publication Data

US 2003/0193376 A1 Oct. 16, 2003

(51) Int. Cl.[7] ..... H01P 5/04
(52) U.S. Cl. ..... 333/34; 333/25; 333/26
(58) Field of Search ..... 333/25, 26, 32–34

(56) References Cited

U.S. PATENT DOCUMENTS 3,835,423 A * 9/1974 Parisi ..... 333/98 M
3,928,825 A * 12/1975 Kaffenberger et al. ..... 333/34
4,745,377 A * 5/1988 Stern et al. ..... 333/26

* cited by examiner

*Primary Examiner*—Kenneth B. Wells
(74) *Attorney, Agent, or Firm*—William E. Koch

(57) ABSTRACT

A stripline integrated circuit apparatus comprising a first ground plane, a stripline section positioned on the first ground plane, the stripline section including N stripline regions where N is a whole number greater than or equal to one, wherein each stripline region includes a stripline sandwiched therebetween a first dielectric layer with a thickness and a second dielectric layer with a thickness where each adjacent stripline is connected in parallel, wherein each adjacent stripline region is separated by a ground plane, a second ground plane positioned on the stripline region, and wherein the plurality of stripline sections are formed and electrically connected in series. The distances between the striplines and the ground planes are adjusted to vary the input and output impedance.

25 Claims, 2 Drawing Sheets

150

BROAD BAND IMPEDANCE MATCHING DEVICE WITH REDUCED LINE WIDTH

FIELD OF THE INVENTION

This invention relates to an impedance matching device.

More particularly, the present invention relates to stripline used to form electronic impedance transformers on low temperature co-fired ceramics.

BACKGROUND OF THE INVENTION

Impedance transformers, also known as impedance matching circuits, are used to connect circuits or devices of differing impedances in order to obtain maximum performance. For example, a power amplifier with an output impedance of 4Ω would need an impedance transformer in order to get maximum power transferred to a 50Ω antenna. With the proliferation of multi-mode, multi-band wireless systems and the advent of the software definable radio, broadband impedance transformers will play a crucial role in these systems. Without some form of broadband output matching network, multi-band radios would require a multiplicity of narrow, single band radio frequency (hereinafter referred to as RF) power amplifiers. However, single band RF power amplifiers are typically large in size and expensive to fabricate. Further, they tend to have large, unwanted inductive parasitics.

Tapered striplines with a constant ground plane spacing have been used as broadband impedance transformer, but have limited use due to the lengths of the striplines and the extreme line width ratio even for modest impedance ratios. The line width ratio is the width of the input divided by the width of the output. For example, a stripline (or line) that requires a 10 mil line width for a 50Ω output would need a 350 mil stripline for a 4Ω input, wherein the line width ratio is 1:35. In this case, the 4Ω stripline requires a large package and in addition, makes for a complicated feed structure to a small surface mount component, such as a transistor.

Conversely, a stripline that requires a 40 mil stripline width for 4Ω input would need a 0.65 mil stripline width for 50Ω output, wherein the line width ratio is 1:61 (This assumes a stripline type transmission line, a dielectric constant of 7.8, and a dielectric height of 44 mils). In this case, the thin stripline for the 50Ω output would significantly increase the loss of the transformer. Thus, if a stripline could be invented in which the ground plane spacing decreased along the length of the stripline, a transformer could be built in which the taper of the stripline could be reduced or eliminated.

It would be highly advantageous, therefore, to remedy the foregoing and other deficiencies inherent in the prior art.

SUMMARY OF THE INVENTION

To achieve the objects and advantages specified above and others, a new and improved impedance matching device is disclosed. The impedance matching device includes a ground plane, a stripline section positioned on the ground plane, the stripline section including N stripline regions wherein N is a whole number greater than or equal to one. Each stripline region includes a stripline sandwiched therebetween dielectric layers. Each adjacent stripline in the same section is connected in parallel wherein each adjacent stripline region is separated by a ground plane. Further, the thicknesses of the dielectric layers in at least one stripline section is greater than the thickness of the dielectric layers in an adjacent stripline section so that the distance between the stripline and the ground plane varies.

In the preferred embodiment, the striplines are tapered and the adjacent stripline within the same stripline section are electrically connected in parallel through conductive vias. A ground plane is positioned on the stripline region wherein a plurality of stripline sections are formed and electrically connected in series through conductive vias.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the following drawings.

DETAILED DESCRIPTION OF THE PREFERRED EMBODIMENT

Figure 1:
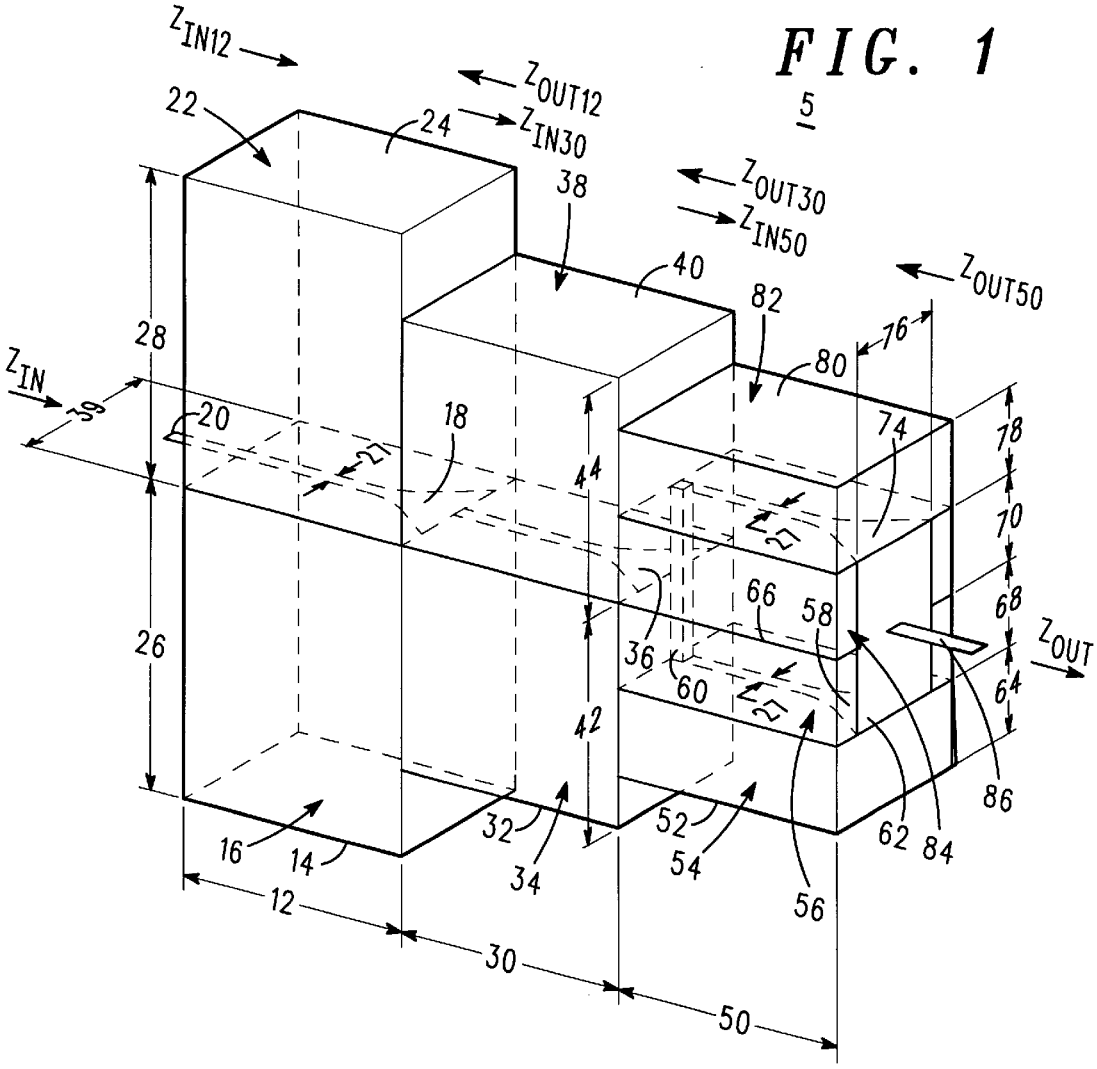
FIG. 1 is an isometric view of a broad band impedance matching device in accordance with the present invention.

Turn now to FIG. 1, which illustrates an isometric view of a simplified broad band impedance matching device 5 with a bandwidth in accordance with the present invention. Impedance matching device 5 includes a plurality of stripline sections electrically connected in series through conductive vias. Device 5 also includes an input impedance, $Z_{in}$, and an output impedance, $Z_{out}$. $Z_{in}$ is the impedance measured at an input 20 and $Z_{out}$ is the impedance seen when measured at an output 86, as will be discussed separately. In this example, impedance matching device 5 includes a stripline section 12, a stripline section 30, and a stripline section 50, which are illustrated as individual units for convenience of description.

As illustrated in FIG. 1, section 12 has input impedance $Z_{in12}$ and an output impedance $Z_{out12}$, section 30 has an input impedance $Z_{in30}$ and an output impedance $Z_{out30}$, and section 50 has an input impedance $Z_{in50}$ and output impedance $Z_{out}$. In general, a stripline section is sandwiched therebetween ground planes and includes N stripline regions wherein N is a whole number greater than or equal to one. The spacing between ground planes in the same section and the stripline taper can be adjusted to obtain the desired $Z_{in}$ and $Z_{out}$. A stripline region includes a stripline with a characteristic impedance sandwiched therebetween dielectric layers, wherein each dielectric layer has a thickness and wherein each adjacent stripline in the same section is connected in parallel. By connecting each adjacent stripline in parallel, the line width ratio is reduced, as will be discussed separately. Further, each adjacent stripline region in the same section is separated by a ground plane.

For example, in this simplified embodiment, stripline section 12 includes a ground plane 14 whereon a dielectric layer 16 with a thickness 26 is positioned. A tapered stripline 18 with an input width 27, an output width 39, and a characteristic impedance is positioned thereon dielectric layer 16. A dielectric layer 22 with a thickness 28 is positioned on tapered stripline 18 and dielectric layer 16, and a ground plane 24 is positioned thereon dielectric layer 22, wherein N is equal to one. In this embodiment, thickness 26 is chosen to be equal to thickness 28, as will be discussed separately. Further, input 20 is electrically connected to tapered stripline 18.

In this example, stripline section 30 includes a ground plane 32, a dielectric layer 34 with a thickness 42 positioned on ground plane 32, a tapered stripline 36 with an input width 27, an output width 39, and a characteristic impedance positioned on dielectric layer 34, a dielectric layer 38 with a thickness 44 positioned on tapered stripline 36 and dielectric layer 34, and a ground plane 40 positioned on dielectric layer 38, wherein N is equal to one. In this embodiment, thickness 42 is chosen to be equal to thickness 44, as will be discussed separately. Further, as discussed previously, tapered stripline 36 is electrically connected in series to tapered stripline 18. It will be understood that the electrical connections between input 20, tapered stripline 18, and tapered stripline 36 are made through conductive vias, which are not illustrated in FIG. 1 for simplicity.

Stripline section 50, wherein N is equal to two, includes a ground plane 52, a dielectric layer 54 with a thickness 64 positioned on ground plane 52, a tapered stripline 58 with an input width 27, an output width 76, and a characteristic impedance positioned on dielectric layer 54, a dielectric layer 56 with a thickness 68 positioned on tapered stripline 58 and dielectric layer 54, and a ground plane 66 positioned on dielectric layer 56. A dielectric layer 84 with a thickness 70 is positioned on ground plane 66. A tapered stripline 74 with an,input width 27, an output width 76, and a characteristic impedance is positioned on dielectric layer 84. A dielectric layer 82 with a thickness 78 is positioned on tapered stripline 74 and dielectric layer 84, and a ground plane 80 is positioned on dielectric layer 82.

In this example, dielectric layers 16, 22, 34, 38, 54, 56, 82, and 84 include a low temperature co-fired ceramic. However, tit will be understood that other materials may be suitable. A low temperature co-fired ceramic is used in this embodiment because of its frequency response characteristics.

Further, tapered stripline 58 is electrically connected in parallel with tapered stripline 74 through conductive vias 60 and 62, wherein conductive via 60 is electrically connected to tapered stripline 36 and conductive via 62 is electrically connected to output 86. In this example, thicknesses 64, 68, 70, and 78 are chosen to be equal, as will be discussed presently. Also, ground planes 14, 24, 32, 40, 52, 66, and 80 are each electrically isolated from tapered striplines 18, 36, 58, and 74.

The capacitance of a stripline can be described by the following relation:

$$C \propto \frac{w}{h}, \tag{1}$$

where C is the capacitance of the stripline, w is the width of the stripline, and h is the distance of the stripline from a ground plane. The inductance of a stripline can be described by the following relation:

$$L \propto \frac{h}{w}, \tag{2}$$

where L is the inductance of the stripline. The characteristic impedance, $Z_c$, of a transmission line is given as $$Z_c = \sqrt{\frac{L}{C}}. \tag{3}$$

The characteristic impedance required to match a quarter-wave transmission line to a high and low impedance is given as $$Z_c = \sqrt{Z_H Z_L}, \tag{4}$$

where $Z_H$ is the impedance at a high impedance end of a stripline and $Z_L$ is the impedance at a low impedance end of a stripline. Thus, C and L can be adjusted by varying w and h to adjust $Z_c$ and to obtain the desired impedance transformation.

For example, in the preferred embodiment, $Z_{in}$ is equal to 50Ω and $Z_{out}$ is equal to 4Ω so that impedance matching device 5 is capable of transforming a 4Ω resistance at the output of a power amplifier into a 50Ω resistance of an antenna, for example. To accomplish the impedance matching, thickness 26 (and thickness 28) is made greater than thickness 42 (and thickness 44), and thickness 42 is made greater than thickness 64 (and thicknesses 68, 70, and 78). Thus, $Z_{in}$ is transformed to $Z_{out12}$ by Equation 3 wherein the characteristic impedance of stripline 18 is chosen by thicknesses 16 and 22 and widths 27 and 39 and the taper of stripline 18.

For maximum power transfer between stripline sections 12 and 30, $Z_{out12}$ is chosen to be approximately equal to $Z_{in30}$. To accomplish this, thicknesses 42 and 16 are adjusted to obtain the desired impedance matching between sections 12 and 30. In this example, since width 27 of stripline 36 is smaller than width 39, thickness 42 is chosen to be smaller than thickness 16. Further, $Z_{in30}$ is transformed to $Z_{out30}$ by Equation 3 wherein the characteristic impedance of stripline 36 is chosen by thicknesses 42 and 44 and widths 27 and 39 and the taper of stripline 36.

For maximum power transfer between stripline sections 30 and 50, $Z_{out30}$ is chosen to be approximately equal to $Z_{in50}$. Since width 27 of striplines 58 and 74 are smaller than width 39, thicknesses 64, 68, 70, and 78 are chosen to be smaller than thickness 42. Further, $Z_{in50}$ is transformed to $Z_{out50}$ (and $Z_{out}$) by Equation 3 wherein the characteristic impedance of striplines 58 and 74 are chosen by thicknesses 64, 66, 70, and 78, and widths 27 and 76 and the taper of striplines 58 and 74.

As mentioned previously, striplines 58 and 74 are connected in parallel to reduce the input and output line width ratios and to achieve the desired output impedance. In general, to decrease the output impedance, either the line width is increased or the dielectric thickness is reduced. However, if the line width is increased, then the size of the impedance matching device increases and if the dielectric thickness is reduced, then the quality factor of the impedance matching device is reduced.

For example, a 4Ω stripline will have a line width of approximately 83 mil for a given dielectric thickness and dielectric constant and requires a large package and a complicated feed structure to a small surface mount component, such as a transistor. However, a 8Ω stripline will have a line width of approximately 39 mil for the same dielectric thickness and dielectric constant. Since in the preferred embodiment, $Z_{out}$ is chosen to be 4Ω, two 8Ω striplines in stripline section 50, for example, are connected in parallel, as illustrated in FIG. 1. Hence, the line width ratio has been reduced to 2:1 for stripline section 50 and the size of impedance matching device 5 is reduced.

Figure 2:
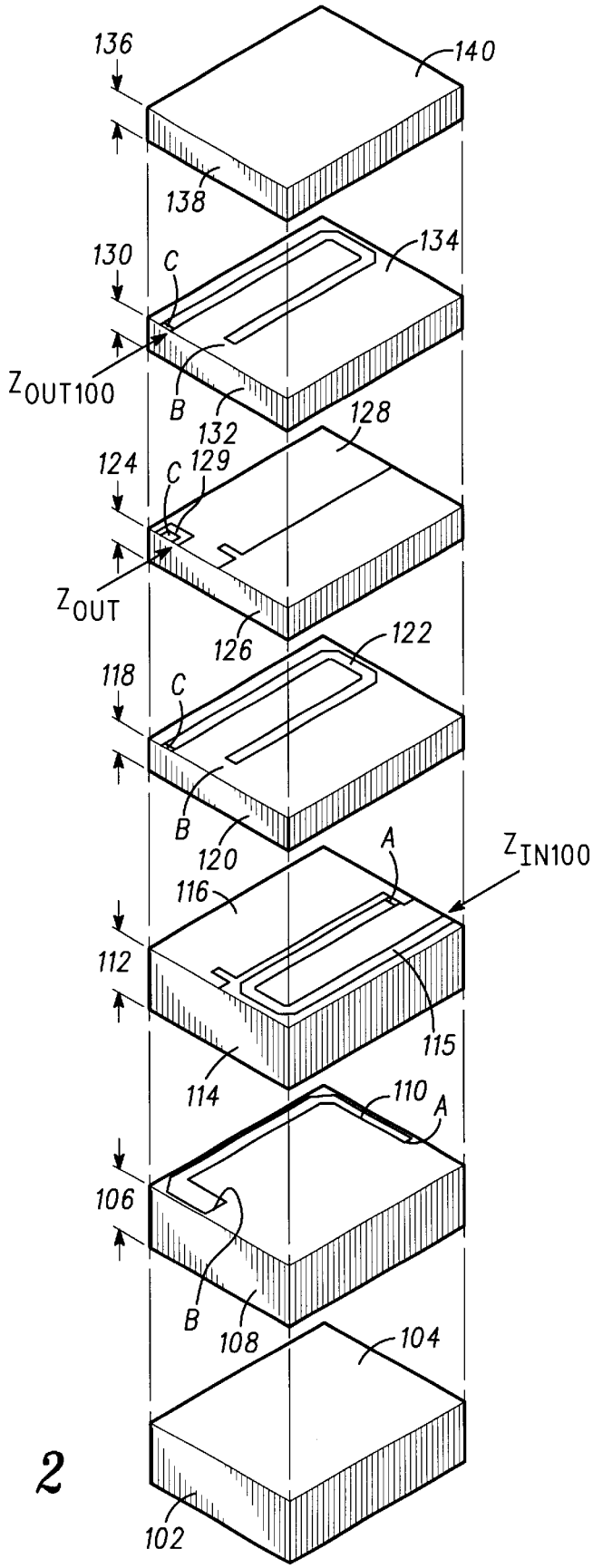
FIG. 2 is an exploded view of a broad band impedance matching device in accordance with the present invention.

The stripline sections illustrated in FIG. 1 are formed compactly in a preferred embodiment, as illustrated in FIG. 2, wherein an exploded view of an impedance matching device 100 is shown. Device 100 includes a layer 102 with a ground plane 104. A layer 108 with a thickness 106 is formed on layer 102 wherein layer 106 includes a tapered stripline 110. A layer 114 with a thickness 112 is formed on layer 108 wherein layer 114 includes a tapered stripline 115 with an input 114 and a ground plane 116.

A layer 120 with a thickness 118 is formed on layer 114 wherein layer 120 includes a tapered stripline 122. A layer 126 with a thickness 124 is formed on layer 120 wherein layer 126 includes a ground plane 128. A layer 132 with a thickness 130 is formed on layer 126 wherein layer 132 includes a tapered stripline 134. A layer 138 with a thickness 136 is formed on layer 132 wherein layer 138 includes a ground plane 140. In the preferred embodiment, layers 102, 108, 114, 120, 126, 132, and 138 include a low temperature co-fired ceramic material. However, it will be understood that other dielectric materials may by suitable. A low temperature co-fired ceramic material is used in this embodiment because of its frequency response characteristics.

In FIG. 2, tapered stripline 115 is electrically connected to tapered stripline 110 at point A through a conductive via (not shown). Tapered stripline 110 is electrically connected to tapered striplines 122 and 134 at point B through a conductive via (not shown). Further, tapered striplines 122 and 134 are electrically connected to an output 129 at point C through conductive vias (not shown). The impedance measured at input 114 is $Z_{in100}$ and the impedance measured at output 129 is $Z_{out100}$.

In this embodiment, tapered striplines 122 and 134 are connected in parallel to reduce the input and output line width ratio, wherein the line width ratio has been reduced to 4:1 and the size of impedance matching device 100 is reduced by approximately five times.

Figure 3:
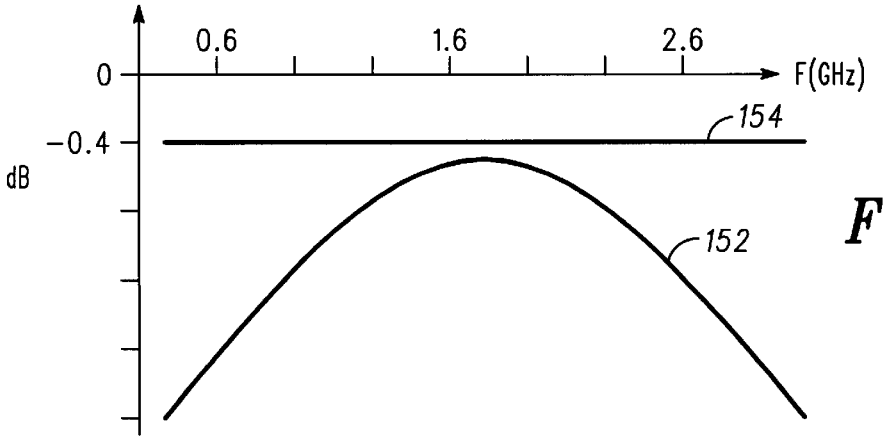
FIG. 3 is a graph illustrating the frequency response of a prior art impedance transformer and a broad band impedance matching device in accordance with the present invention.

FIG. 3 illustrates a graph 150 of a frequency response 154 of impedance matching device 5 and a frequency response 152 of an impedance matching device typically found in the prior art. Frequency response 154 is much broader over the frequency range indicating that impedance matching can be accomplished over a wider range of frequencies.

Thus, impedance matching device 5 behaves like a broadband impedance transformer in which the input and output line width ratios have been significantly reduced resulting in improved performance, smaller size, improved quality factor, and more manageable input and output connections. In addition, the stripline section with the lowest impedance has been split into two striplines with double the impedance and then connected in parallel to further reduce the width of the stripline. Further, the stripline taper has been significantly reduced. The input and output stripline widths ratios can be made to be 4:1 and the size of impedance matching device 5 is reduced by approximately five times.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

What is claimed is:

1. An impedance matching stripline integrated circuit apparatus comprising:

a plurality of stripline sections each sandwiched between ground planes, the stripline sections being electrically connected in series, each section including N stripline regions, wherein N is a whole number greater than or equal to one;

wherein each stripline region includes a stripline sandwiched between a first dielectric layer with a first thickness and a second dielectric layer with a second thickness; and wherein the first and second thicknesses in each of the plurality of stripline sections are different from the thickness of the first and second dielectric layers in adjacent stripline sections.

2. An apparatus as claimed in claim 1 wherein at least one stripline section includes two adjacent stripline regions, the striplines in the adjacent stripline regions being connected in parallel and a common ground plane sandwiched between the adjacent stripline regions.

3. An apparatus as claimed in claim 1 wherein the stripline sections are connected in series through conductive vias.

4. An apparatus as claimed in claim 2 wherein the adjacent striplines are electrically connected together through conductive vias.

5. An apparatus as claimed in claim 1 wherein at least one of the striplines is tapered.

6. An apparatus as claimed in claim 1 wherein the first thickness is equal to the second thickness.

7. An apparatus as claimed in claim 1 wherein at least one stripline region includes a low temperature co-fired ceramic.

8. An impedance matching stripline integrated circuit apparatus comprising:

a first ground plane;

a stripline section positioned on the first ground plane, the stripline section including N stripline regions where N is a whole number greater than or equal to one;

wherein each stripline region includes a stripline sandwiched between a first dielectric layer with a first thickness and a second dielectric layer with a second thickness;

wherein the first and second thicknesses in each of the plurality of stripline sections are different from the thickness of the first and second dielectric layers in adjacent stripline sections;

a second ground plane positioned on the stripline region; and wherein a plurality of stripline sections are formed and electrically connected in series.

9. An apparatus as claimed in claim 8 wherein at least one stripline section includes two adjacent stripline regions, the striplines in the adjacent stripline regions being connected in parallel and a common ground plane sandwiched between the adjacent stripline regions.

10. An apparatus as claimed in claim 8 wherein the stripline sections are connected in series through conductive vias.

11. An apparatus as claimed in claim 9 wherein the adjacent striplines are electrically connected together through conductive vias.

12. An apparatus as claimed in claim 8 wherein at least one of the striplines is tapered.

13. An apparatus as claimed in claim 8 wherein the first thickness is approximately equal to the second thickness.

14. An apparatus as claimed in claim 8 wherein the adjacent striplines are electrically connected together through conductive vias.

15. An apparatus as claimed in claim 8 wherein the first and second thicknesses in at least one stripline section is greater than the thickness of the first and second dielectric layers in an adjacent stripline section.

16. An apparatus as claimed in claim 8 wherein at least one stripline region includes a low temperature co-fired ceramic.

17. A method of transforming the impedance of a stripline with an input impedance and an output impedance, the method comprising the steps of:

forming a first ground plane;

forming a stripline section positioned on the first ground plane, the stripline section including N stripline regions where N is a whole number greater than or equal to one;

wherein each stripline region includes a stripline sandwiched between a first dielectric layer with a first thickness and a second dielectric layer with a second thickness;

wherein the first and second thicknesses in each of the plurality of stripline sections are different from the thickness of the first and second dielectric layers in each adjacent stripline section;

a second ground plane positioned on the stripline region; and wherein a plurality of stripline sections are formed and electrically connected in series.

18. An apparatus as claimed in claim 17 wherein at least one stripline section includes two adjacent stripline regions, the striplines in the adjacent stripline regions being connected in parallel and a common ground plane sandwiched between the adjacent stripline regions.

19. A method as claimed in claim 17 wherein the stripline sections are connected in series through conductive vias.

20. A method as claimed in claim 17 wherein at least one of the striplines is formed with a taper.

21. A method as claimed in claim 20 further including in addition the step of forming the taper to obtain a desired value for at least one of the input and output impedances.

22. A method as claimed in claim 17 wherein the first thickness is approximately equal to the second thickness.

23. A method as claimed in claim 17 wherein the adjacent striplines are electrically connected together through conductive vias.

24. A method as claimed in claim 17 further including the step of forming at least one of the first and second thicknesses to obtain a desired value for at least one of the input and output impedances.

25. A method as claimed in claim 17 wherein at least one stripline region includes a low temperature co-fired ceramic.

* * * * *